US005171205A

United States Patent [19]

Monkenbusch

[11] Patent Number: 5,171,205

[45] Date of Patent: Dec. 15, 1992

[54] SOLID-BOWL CENTRIFUGE WITH AN INTAKE PIPE AND A PEELING DISK

[75] Inventor: Alfons Monkenbusch, Oelde, Fed. Rep. of Germany

[73] Assignee: Westfalia Separator AG, Oelde, Fed. Rep. of Germany

[21] Appl. No.: 668,004

[22] Filed: Mar. 11, 1991

[30] Foreign Application Priority Data

Mar. 10, 1990 [DE] Fed. Rep. of Germany ..... 4007666

[51] Int. Cl.[5] ..... B04B 11/08; B04B 15/00

[52] U.S. Cl. ..... 494/10; 494/41; 494/57

[58] Field of Search ..... 494/2, 3, 10, 41, 43, 494/47, 48, 56-58, 85; 210/360.1, 360.2, 369, 371-376, 776, 781; 366/184; 422/72

[56] References Cited

U.S. PATENT DOCUMENTS

| | | | |
|---|---|---|---|
| 3,135,691 | 6/1964 | Hemfort, Jr. | 494/2 |
| 3,279,688 | 10/1966 | Cook | 494/10 |
| 3,321,131 | 5/1967 | Cook | 494/10 |
| 3,580,492 | 5/1971 | Schnittger et al. | 494/57 X |
| 4,406,652 | 9/1983 | Nielsen | 494/56 |
| 4,464,162 | 8/1984 | Cummings | 494/57 X |
| 4,615,690 | 10/1986 | Ecker | 494/57 X |
| 4,634,416 | 1/1987 | Ehnstrom | 494/56 X |
| 4,662,867 | 5/1987 | Ehnstrom | 494/56 |

FOREIGN PATENT DOCUMENTS 1942490 7/1966 Fed. Rep. of Germany .

*Primary Examiner*—Harvey C. Hornsby
*Assistant Examiner*—C. Cooley
*Attorney, Agent, or Firm*—Sprung Horn Kramer & Woods

[57] ABSTRACT

A solid-bowl centrifuge with an intake pipe and a peeling disk that conveys the peeled-off material out through its hub and comprises a stationary eccentric and a rotating lid that allows the disk to rotate on a carrier positioned in a radial slot. The hub comprises two concentric components, wherein the inner component is secured to the stationary eccentric and the outer component is secured to the rotating peeling-disk lid.

8 Claims, 2 Drawing Sheets

SOLID-BOWL CENTRIFUGE WITH AN INTAKE PIPE AND A PEELING DISK

BACKGROUND OF THE INVENTION

The invention concerns a solid-bowl centrifuge with an intake pipe and a peeling disk that conveys the peeled-off material out through its hub and comprises a stationary eccentric and a rotating lid that allows the disk to rotate on a carrier positioned in a radial slot.

A solid-bowl centrifuge of this type is known from German GM 1 942 490. Since the peeling-disk lid is secured to the intake pipe, the disk can rotate only along with the intake pipe. Accordingly, there must either be an expensive rotating seal between the line and the pipe or the former must be disconnected from the latter to adjust the disk's peeling diameter once the intake line has been permanently installed.

SUMMARY OF THE INVENTION

The object of the instant invention is accordingly to improve the known solid-bowl centrifuge to the extent that the peeling disk can be adjusted without rotating the intake pipe.

This object is attained in accordance with the invention in that the hub comprises two concentric components, whereby the inner component is secured to the stationary eccentric and the outer component is secured to the rotating peeling-disk lid.

How far the disk will immerse itself can now be determined by rotating the outer hub component, and the intake pipe can be stationary.

A runoff chamber is associated with the hub, and the outer hub component rotates in relation to it in one advantageous embodiment of the invention. A runoff line for the peeled-off material can be secured stationary to the runoff chamber in the embodiment.

The runoff chamber in another advantageous embodiment has a rotating cover secured to the outer hub component. The cover facilitates the rotation of the outer hub component.

Other advantageous embodiments are disclosed herein.

One embodiment of the invention will now be specified with reference to the drawings, wherein

DETAILED DESCRIPTION TO THE INVENTION

Figure 1:
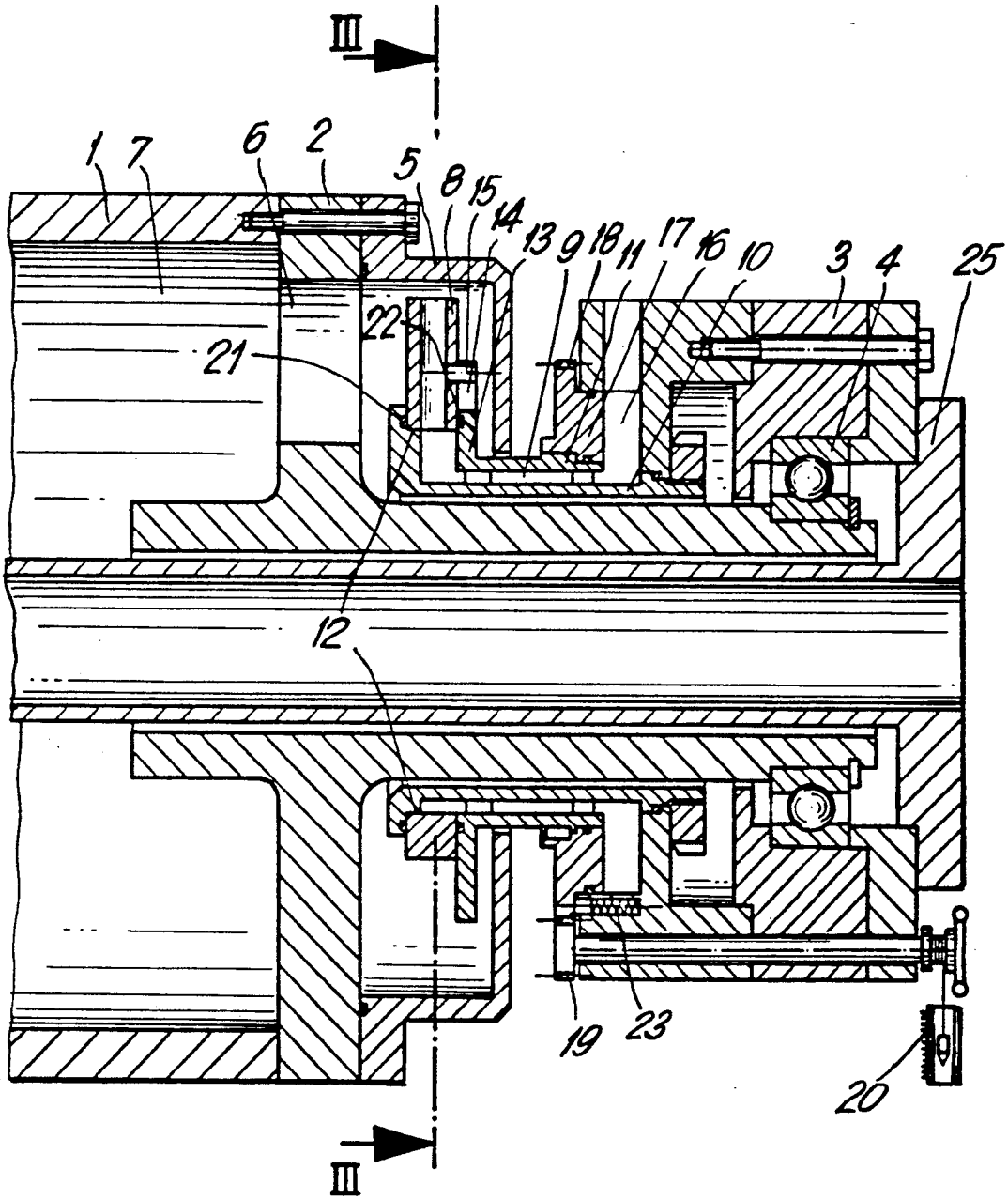
FIG. 1 is a section through part of a solid-bowl centrifuge according to the invention.

Referring to FIG. 1, the hub 2 of a centrifuge drum is secured to a solid bowl 1 and rotates on roller bearings 4 in a housing 3. A peeling chamber 5 that communicates through openings 6 with the inside 7 of bowl 1 is mounted on drum hub 2. Peeling chamber 5 accommodates a peeling disk 8 with a peeling-disk hub 9 comprising an inner component 10 and an outer component 11.

Inner hub component 10 is provided with an eccentric 12 that rotates on peeling disk 8. Secured to outer hub component 11 is a lid 13 with a radial slot 14 that accommodates a pin 15 in peeling disk 8.

The free ends of peeling-disk hub components 10 and 11 open into a runoff chamber 16. Inner hub component 10 is stationary and outer hub component 11 rotates. A cover 17 that rotates in runoff chamber 16 is rigidly secured to outer hub component 11.

Cover 17 has teeth 18 around its circumference. The teeth engage a rotating pinion 19. An indicator 20 is associated with pinion 19, allowing adjustment of the peeling diameter of peeling disk 8.

Peeling disk 8 is sealed off against eccentric 12 and lid 13 by seals 21 and 22, which are forced tight against the facing flat areas of the disk.

Springs 23 exert an axial force against peeling disk 8 and inner hub component 10, forcing lid 13 against peeling disk 8.

Outer hub component 11 can be displaced axially and is forced by the pressure of the liquid in runoff chamber 16 against a flat area on peeling disk 8, augmenting the compression.

Figure 2:
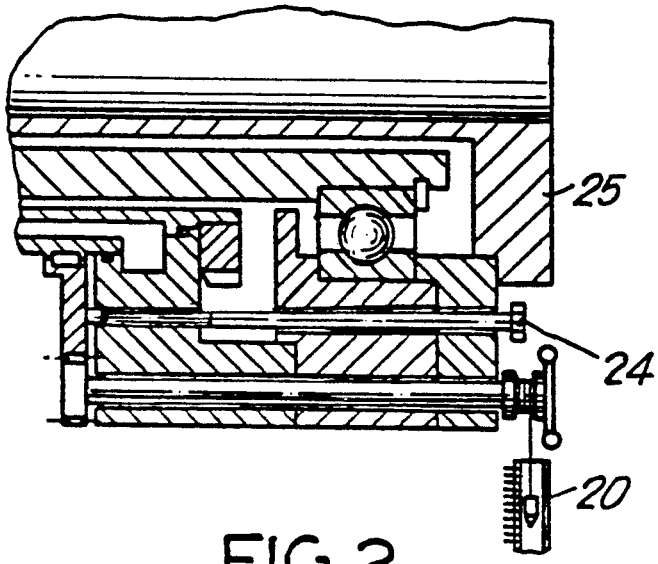
FIG. 2 illustrates a screw employed in FIG. 1 to produce tension.

The compressive force on seals 21 and 22 can also be generated by the screws 24 illustrated in FIG. 2.

Figure 3:
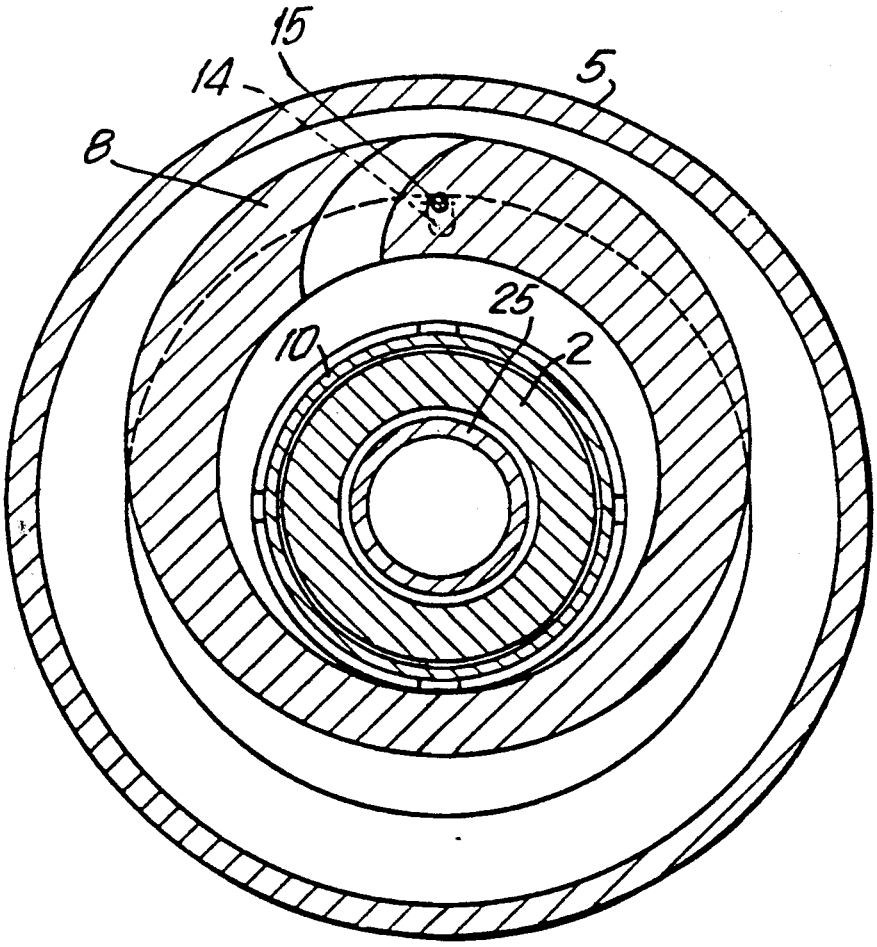
FIG. 3 is a section along the line III—III in FIG. 1.

The peeling disk 8 illustrated in FIG. 3 is in the position that yields the longest peeling diameter. Lid 13 can be rotated 180° to shift peeling disk 8 into the position that yields its most shallow immersion by way of radial slot 14 and pin 15.

Since the center of the drum hub 2 in the centrifuge in accordance with the invention is penetrated by only one intake pipe 25, which supplies product liquid, the diameter of the drum hub 2 in the vicinity of roller bearing 4 can be short. Since intake pipe 25 has no mechanisms for rotating peeling disk 8, it can feature the advantage of being very small and having low inherent frequencies.

What is claimed is:

1. A solid-bowl centrifuge comprising: a bowl; an intake pipe for feeding material into the bowl; means forming a peeling chamber in communication with the bowl; a rotatable peeling disk in the peeling chamber having a peeling disk hub comprising radially inner and outer components with the peeling disk conveying peeled-off material out through the hub, wherein the inner component has a stationary eccentric at one end and the outer component has a lid connected thereto at one end, said lid having a radial slot and wherein the peeling disk has a pin received in the slot whereby the outer component and lid rotate with the peeling disk relative to the inner component and eccentric; and means forming a runoff chamber at the other end of the inner and outer components such that the outer component rotates relative to the runoff chamber.

2. The solid-bowl centrifuge as in claim 1, wherein the runoff chamber has a rotatable cover secured to the outer hub component.

3. The solid-bowl centrifuge as in claim 2, wherein the cover is circular and has teeth around a circumference thereof and further comprising a rotatable pinion engaging the teeth.

4. The solid-bowl centrifuge as in claim 1, further comprising an indicator for indicating a peeling diameter of the peeling disk.

5. The solid-bowl centrifuge as in claim 1, wherein the peeling disk has flat areas and the eccentric and lid have seals forced tight against said flat areas of the peeling disk.

6. The solid-bowl centrifuge as in claim 5, further comprising springs exerting a compressive force against the seals.

7. The solid-bowl centrifuge as in claim 5, further comprising screws for generating a compressive force on the seals.

8. The solid-bowl centrifuge as in claim 5, wherein the inner and outer components of the peeling disk hub are connected to the runoff chamber to allow pressure of liquid in the runoff chamber to exert a compressive force on the seals.

* * * * *